United States Patent [19]

Schwing et al.

[11] Patent Number: 4,869,756

[45] Date of Patent: Sep. 26, 1989

[54] PROCESS FOR CARBURIZING A STEEL WORKPIECE

[76] Inventors: Ewald Schwing, Wiesfurthstr. 99, D-4133 Neukirchen-Vluyn; Peter Sommer, Johann-Strauss-Str. 13; Horst Uhrner, Schumannstr. 9, both of D-4174 Issum 2, all of Fed. Rep. of Germany

[21] Appl. No.: 163,629

[22] Filed: Mar. 3, 1988

[30] Foreign Application Priority Data

Mar. 5, 1987 [DE] Fed. Rep. of Germany ..... 3707003

[51] Int. Cl.[4] ..... C21D 1/00

[52] U.S. Cl. ..... 148/16.5; 148/16

[58] Field of Search ..... 148/16, 16.5

[56] References Cited

U.S. PATENT DOCUMENTS

| | | | |
|---|---|---|---|
| 3,925,109 | 12/1975 | Nilsen | 148/16.5 |
| 4,108,693 | 8/1978 | L'Hermite et al. | 148/16.5 |
| 4,168,186 | 9/1979 | Limque et al. | 148/16.5 |
| 4,306,918 | 4/1980 | Kaspersma et al. | 148/16.5 |
| 4,306,919 | 12/1981 | Roberge et al. | 148/16.5 |
| 4,372,790 | 2/1983 | Göhring et al. | 148/16.5 |
| 4,472,209 | 9/1984 | Längerich et al. | 148/13 |
| 4,583,942 | 9/1984 | Schwing et al. | 432/58 |
| 4,599,067 | 9/1984 | Schwing et al. | 432/58 |
| 4,620,883 | 9/1984 | Schwing et al. | 148/13 |
| 4,627,175 | 11/1984 | Schwing et al. | 34/57 A |
| 4,744,839 | 5/1988 | Quelle | 148/16.5 |

FOREIGN PATENT DOCUMENTS

| | | | |
|---|---|---|---|
| 3139622 | 4/1983 | Fed. Rep. of Germany . | |
| 3436267 | 5/1986 | Fed. Rep. of Germany | 148/16.5 |
| 3507527 | 5/1986 | Fed. Rep. of Germany . | |

OTHER PUBLICATIONS

Merkblatt Stahl 452 pp. 2–22, 1981.

*Primary Examiner*—Upendra Roy
*Attorney, Agent, or Firm*—Herbert Dubno

[57] ABSTRACT

The process carburizes a steel workpiece, particularly a steel piece made of casehardened steel, to a predetermined surface carbon content in a fluidized bed oven. In a first carburizing step one carburizing gas is used whose carbon content exceeds that corresponding to the surface carbon set or desired content and whose C-level is above the soot limit. Thus an actual surface carbon content is provided which lies above the predetermined surface carbon set or desired content. Then after that in the same fluidized bed oven a diffusion treatment of the workpiece is performed in another carburizing gas which has a C-level above the soot limit, but a reduced carbon content relative to the first carbon containing gas, this carbon content being less than or equal to that corresponding to the surface carbon set or desired content. The described sequence of carburization followed by diffusion treatment is repeated until a predetermined carbon depth or penetration is reached. The surface carbon set or desired content is adjusted in a final diffusion process.

2 Claims, 1 Drawing Sheet

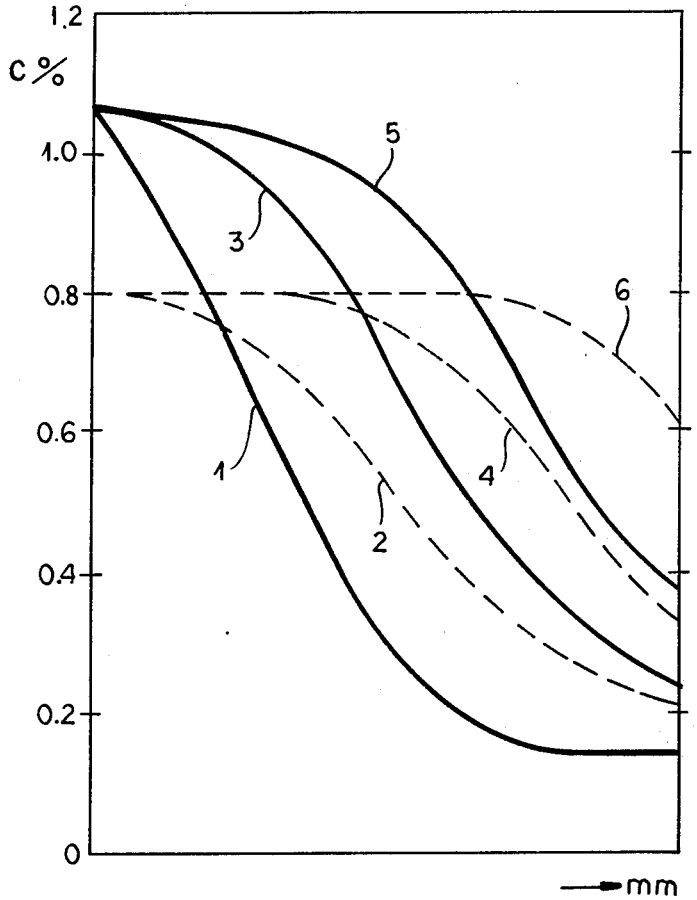
1.2
C %
1.0
0.8
0.6
0.4
0.2
0
mm
1
2
3
4
5
6

PROCESS FOR CARBURIZING A STEEL WORKPIECE

FIELD OF THE INVENTION

Our present invention relates to the carburization of a workpiece made of steel, particularly case-hardenable steel.

BACKGROUND OF THE INVENTION

A process for carburizing a steel workpiece to a predetermined surface carbon setpoint value or desired concentration in a fluidized bed oven is known in which in a first carburization step a carburizing gas is used with a C-level above the soot limit and an actual surface carbon content is produced which is above the predetermined surface carbon setpoint or desired value. After that in the fluidized bed oven a diffusion treatment of the workpiece is performed and the actual surface carbon content or value is reduced. Then the carburization step and the diffusion treatment can be repeated if desired.

In the known process (German Pat. No. 35 07 527) the diffusion treatment uses an inert gas. That allows a very exact adjustment of the surface carbon content to a predetermined surface carbon setpoint value or desired content.

If simultaneously the carburized depth or penetration is to be established with precision, difficulties can arise in regard to the simultaneous adjustment of both parameters, because the parameters are physically coupled. Particularly a deeper carburizing depth or penetration demands a comparatively long treatment time.

OBJECTS OF THE INVENTION

It is an object of our invention to provide an improved process for carburizing a steel workpiece which avoids the above mentioned drawbacks.

It is also an object of our invention to provide an improved process for carburizing a steel workpiece in which both the surface carbon content and also the carburization depth or penetration can be very precisely adjusted or set independently of each other in a comparatively short treatment time.

It is another object of our invention to provide an improved process for carburization of a steel workpiece in which the carburization profile can be set very precisely in a very short processing time.

SUMMARY OF THE INVENTION

These objects and others which will become more readily apparent hereinafter are attained in accordance with our invention in a process for carburizing a steel workpiece to a predetermined surface carbon setpoint value or desired content in a fluidized bed oven. The process comprises a carburization step in which a carburizing gas is used with a C-level above the soot limit and an actual surface carbon content is produced which is above the predetermined surface carbon setpoint value or desired value. After that in the fluidized bed oven a diffusion treatment of the workpiece is performed and the actual surface carbon content is reduced. Then the carburization step and the diffusion treatment are repeated.

According to our invention the diffusion treatment is performed in another carburizing gas which has a C-level above the soot limit and then the carburization step and the diffusion treatment are repeated until a predetermined carburized depth or penetration has been attained and the surface carbon setpoint value or desired content is reached or adjusted in a final diffusion process, also with the second carburizing gas.

According to our invention an additional parameter is introduced which is the carbon content of the carburizing gas used in the diffusion treatment. This largely eliminates the disturbing coupling of the penetration depth and surface carbon content parameters. According to our invention, carbon which contributes to the carbon depth or penetration is subsequently supplied during the diffusion treatment from the carburizing gas.

In the carburizing step the carbon transfer from the gas phase is larger than the carbon transport by diffusion in the workpiece which leads to an increase of the surface carbon content. The diffusion treatment is also performed in a carburizing gas. The carbon transport from the gas phase is smaller than the carbon transport in the workpiece by diffusion which reduces the surface carbon content (for the related carbon transport, diffusion and the like steps see *Merkblatt "Stahl"* 452, 1981, pages 4 and 5).

BRIEF DESCRIPTION OF THE DRAWING

The above and other objects, features and advantages of our invention will become more readily apparent from the following description, reference being made to the accompanying drawing in which the sole FIGURE is a graph illustrating the invention.

SPECIFIC DESCRIPTION

The solid-line curve 1 in the graph in the drawing shows the carbon content in the surface region of the workpiece after shutoff of the first carburizing step. On the ordinate the carbon content in percent is plotted while on the abscissa the distance from the surface is shown.

With the diffusion treatment the dashed curve 2 diverges from this curve 1.

Also with the diffusion treatment one can work with a carburizing gas which has a C-level above the soot limit. Of course the carbon content in this carburizing gas for the diffusion step is considerably reduced compared with the carbon content in the first carburizing gas, i.e. the gas for the first carburizing step.

In this connection one could carburize at the already indicated actual surface carbon content repeatedly and subsequently perform a diffusion treatment.

The solid-line curves 3 and 5 show the course of this carburization.

The subsequent diffusion treatments lead to the dashed-line curves 4 and 6 and thus to the desired carburization profile. If one works with an inert gas in the diffusion step in the predetermined time the carburization profile 6 in the graphical representation is not the result of the process. Also one does not attain the desired accuracy for the carburization step.

The entire process can be performed with a very short treatment time because the process works with a carbon level above the soot limit.

SPECIFIC EXAMPLE

The method of the invention is applied to case hardening steels including 20 MoCr4, 15 MnCr5, 25 MoCr4, 20 MnCr5, 15 CrNi6, 17 CrNiMo6 and 18 CrNi8, which can, after carburizing, be used as tool steel, e.g. as inserts for lathe cutting tools.

By contrast to the method described in German Pat. No. 3507527, the carburizing steps are alternated with diffusion steps.

As shown in the drawing three carburizing steps 1, 3, 5 are carried out in a fluidized bed apparatus of the type used in the German Patent at a temperature of 900° C. with a carburizing gas whose carbon potential or level is 1.15% carbon and which contains, for that purpose, methane or carbon monoxide. Each of the three carburizing treatments is effected for about 40 minutes.

Alternating with the carburizing treatment are diffusion intervals 2, 4, 6 in which, rather than an inert gas, a gas is introduced at a carbon potential of 0.8%. Each diffusion interval lasts about 9 minutes and the final diffusion is represented by the broken line curve 6 of the drawing.

The abscissa of the drawing represents linearly about 1 mm penetration, full scale.

Utilizing the method of the invention, over a total period of approximately 147 minutes, one can obtain a carbon level at a depth of about 1 mm of about 0.6%.

By contrast, in the system of the aforementioned patent in a similar total period or even a longer period, the carbon content to a depth of about 0.5 mm remains below 0.5% C.

We claim:

1. A process for carburizing a steel workpiece, particularly made of a case-hardenable steel, comprising:

(a) carburizing said steel workpiece in a fluidized bed oven with a first carburizing gas whose C-level is above the soot limit, but below that of said first carburizing gas to produce an actual surface carbon content above a predetermined surface carbon setpoint value;

(b) thereafter performing a diffusion treatment of said steel workpiece in said fluidized bed oven in another carburizing gas which has a C-level above said soot limit, but below that of said first carburizing gas; and (c) repeating said carburizing described in step (a) followed by said diffusion treatment described in step (b) until a predetermined carburized depth has been reached in a final diffusion step.

2. A method of carburizing a steel workpiece to a predetermined carbon setpoint value within a surface zone of the workpiece and at a predetermined depth below a surface thereof, said method comprising:

(a) heating a case-hardenable steel workpiece selected from the group which consists of 20MoCr4, 15MnCr5, 25MoCr4, 20MnCr5, 15CrNi6, 17CrNiMo6 and 18CrNi8 in a fluidized-bed furnace at a temperature of about 900° C.;

(b) carburizing the case-hardenable steel workpiece heated in said fluidized-bed furnace by contacting same with a first carburizing gas having a first carbon level for a relatively long period of time to generate a carbon gradient across said zone ranging from a carbon content above said setpoint valve at said surface to a carbon content below said setpoint value at said predetermined depth;

(c) thereafter diffusing carbon in said zone of the casehardenable steel workpiece carburized in said fluidized-bed furnace by contacting same with a second carburizing gas having a carbon level below said first carbon level for a relatively short period of time to generate a carbon gradient across said zone ranging from a carbon content above said setpoint valve at said surface to a carbon content above the carbon content at said predetermined depth resulting from a preceding carburizing; and (d) repeating steps (b) and (c) in alternation until said predetermined carbon setpoint value is reached at conclusion of a step (c) at said predetermined depth.

* * * * *